US005623881A

United States Patent [19]

Huang

[11] Patent Number: 5,623,881

[45] Date of Patent: Apr. 29, 1997

[54] COMPUTER DESK

[76] Inventor: Feng-Chanmr Huang, 4 Fl., No-17-10, Shen Nung Rd., I Lan City, Taiwan

[21] Appl. No.: 606,441

[22] Filed: Feb. 23, 1996

[51] Int. Cl.[6] ..... A47B 35/00

[52] U.S. Cl. ..... 108/50; 108/102; 108/92

[58] Field of Search ..... 108/50, 92, 102, 108/143, 138; 248/918, 917; 211/43, 184

[56] References Cited

U.S. PATENT DOCUMENTS

| | | | |
|---|---|---|---|
| 4,070,075 | 1/1978 | Mortgan | 108/50 X |
| 4,646,655 | 3/1987 | Robolin | 108/92 |
| 5,118,172 | 6/1992 | Ugalde | 108/102 X |
| 5,287,815 | 2/1994 | Gross | 108/50 |
| 5,356,099 | 10/1994 | Sereboff | 248/918 X |
| 5,357,873 | 10/1994 | Hilton | 108/92 X |
| 5,419,525 | 5/1995 | Hilton | 108/50 X |
| 5,490,466 | 2/1996 | Diffrient | 108/50 X |

*Primary Examiner*—Jose V. Chen
*Attorney, Agent, or Firm*—Bacon & Thomas

[57] ABSTRACT

A computer desk including two opposite upright side frames respectively equipped with swivel wheels for moving, each of the upright side frames defining a horizontal sliding track at an inner side, a plurality of top stretchers connected between the upright side frames at a top side by screws, a desk top mounted on the top stretchers, a plurality of back stretchers connected between the upright side frames at a back side at different elevations by screws, a rack mounted on the back stretchers for holding things, a plurality of bottom stretchers connected between the upright side frames at a bottom side by screws, a bottom plate mounted on the bottom stretchers, two rails respectively respectively connected to the horizontal sliding tracks, and a keyboard holder connected between the rails.

15 Claims, 8 Drawing Sheets

COMPUTER DESK

BACKGROUND OF THE INVENTION

The present invention relates to computer desks, and relates more particularly to such a computer desk which has a book stand at the top for holding a number of books, a flat tray beneath a keyboard carrier plate for keeping stationery accessories, and a bottom rack for holding a computer peripheral equipment.

Regular computer desks, as shown in FIG. 1, are commonly heavy, and have little space for holding computer peripheral apparatus. Furthermore, these computer desks are not detachable, therefore they are inconvenient to be delivered to far places.

SUMMARY OF THE INVENTION

It is one object of the present invention to provide a computer desk which has a curved desk top, a rack a bottom plate, and a keyboard holder for holding a variety of computer peripheral apparatus. It is another object of the present invention to provide a computer desk which has a curved desk top with plug holes for mounting a book stand for holding a number of books on the backwardly sloping rear desk top section thereof and for mounting horizontal rods for holding a computer system on the flat front desk top section thereof. It is still another object of the present invention to provide a computer desk which has a keyboard holder which can be conveniently adjusted to the desired elevation and, which is comprised of a flat tray defining a plurality of open chambers for keeping stationery accessories, and a flat keyboard carrier plate with an horizontally adjustable armrest for holding a keyboard. It is still another aspect of the present invention to provide a computer desk which has a sliding rack at the bottom that can be adjusted forwards and backwards to hold a computer peripheral apparatus.

DETAILED DESCRIPTION OF THE PREFERRED EMBODIMENT

Figure 1:
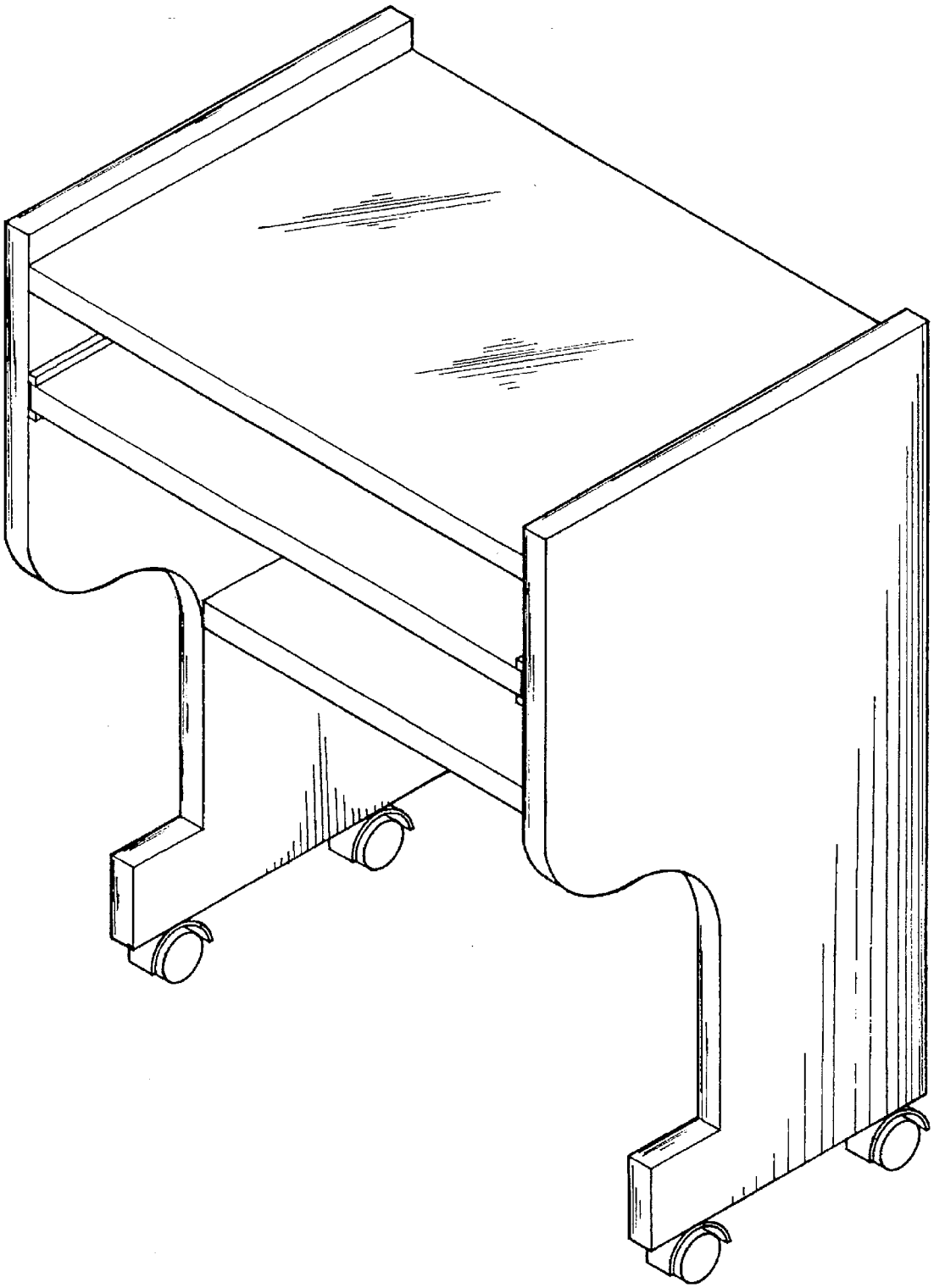
Fig. 1 PRIOR ART
FIG. 1 shows the structure of conventional computer desk.
Figure 2:
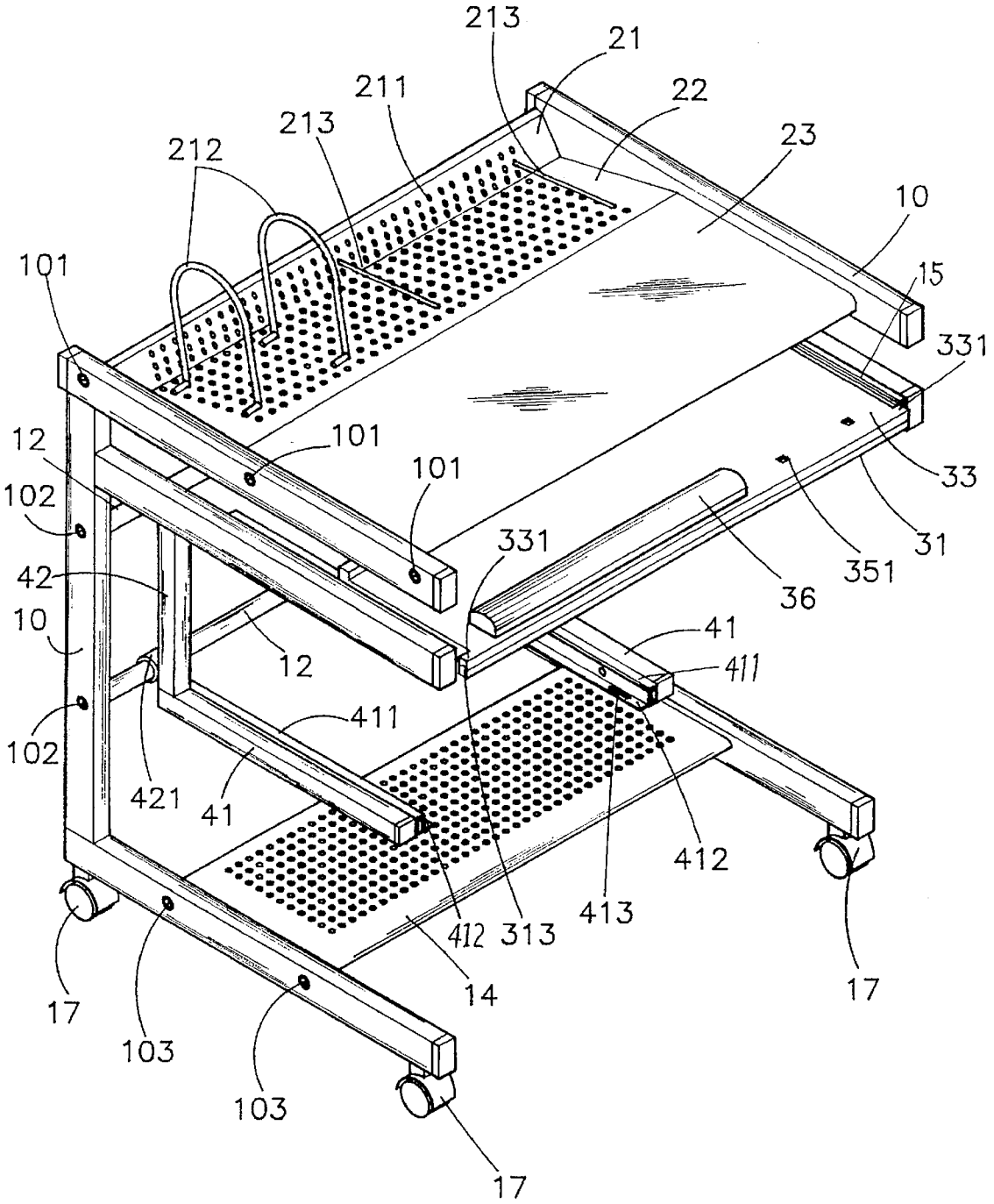
FIG. 2 an elevational view of a computer desk according to the present invention.
Figure 3A:
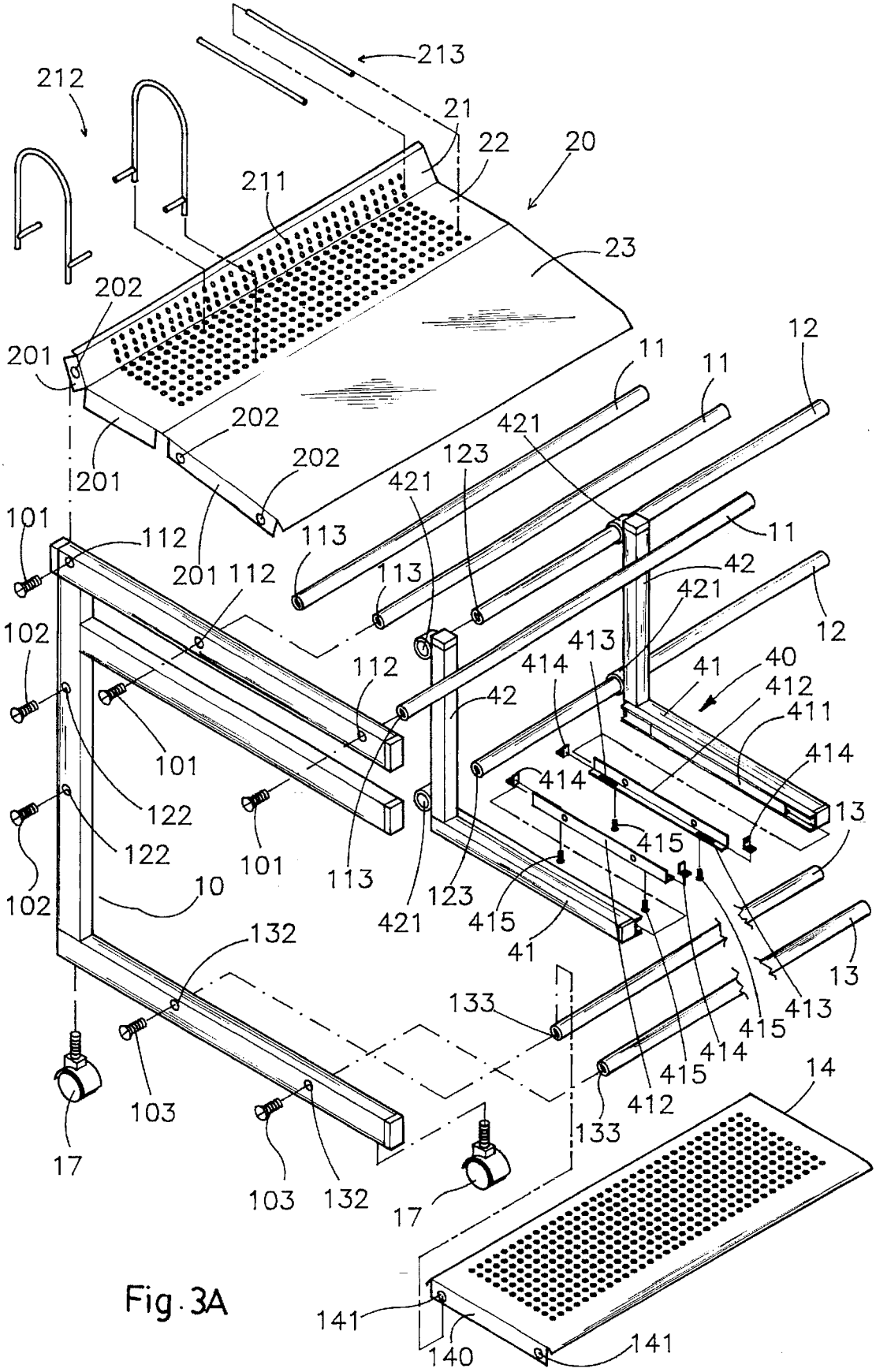
FIG. 3A is an exploded view of the computer desk shown in FIG. 2 (I)
Figure 3B:
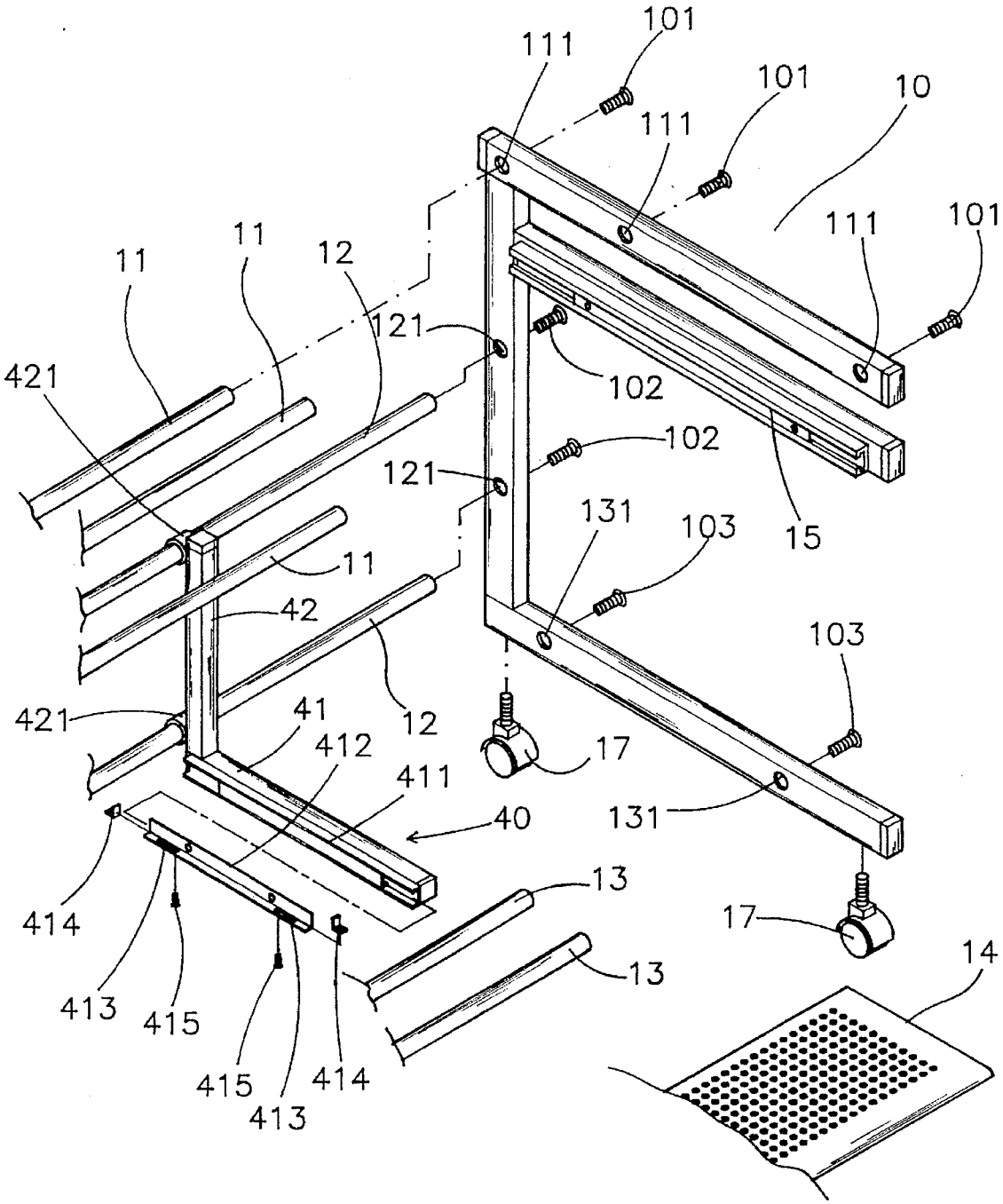
FIG. 3B is an exploded view of computer desk shown in FIG. 2 (II)
Figure 3C:
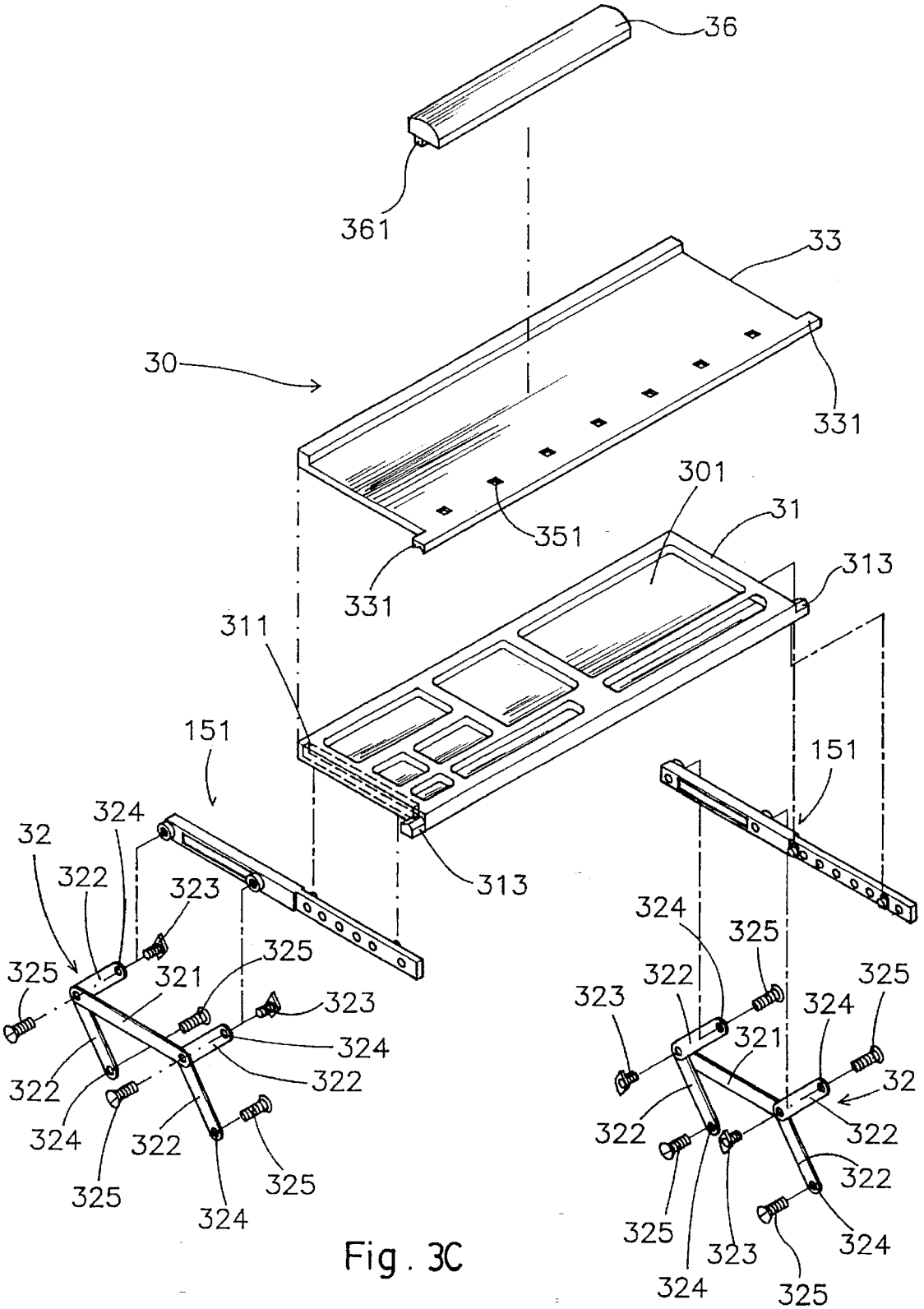
FIG. 3C is an exploded view of the computer desk shown FIG. 2 (III)

Referring to FIGS. from 2 to 4B, a computer desk in accordance with the present invention comprises two opposite upright side frames 10, a plurality of top stretchers 11 connected between the upright side frames 10 at the top side by screws 101, a desk top 20 mounted on the top stretchers 11, a plurality of back stretchers 12 connected between the upright side frames 10 at the back side at different elevations by screws 102, a rack 40 mounted on the back stretchers 12 for holding things, a plurality of bottom stretchers 13 connected between the upright side frames 10 at the bottom side by screws 103, a bottom plate 14 mounted on the bottom stretchers 13, and swivel wheels 17 respectively fastened to the upright side frames 10 at the bottom for supporting the computer desk on the ground. Each of the upright side frames 10 has a plurality of circular recesses 111, 121, 131 at an inner side, which receive the stretchers 11, 12, 13, and a plurality of through holes 112, 122, 132 through the circular recesses 111, 121, 131. The screws 101, 102, 103 are respectively inserted into the through holes 112, 122, 132 from an outer side and then threaded into respective end screw holes 113, 123, 133 of the stretchers 11, 12, 13 to fixedly secure the stretchers 11, 12, 13 and the upright side frames 10 together.

Each of the upright side frames 10 has a horizontal sliding track 15 at an inner side near the top. Two rails 151 are respectively connected to the horizontal sliding tracks 15 by two elevation-adjustable connecting devices 32. A keyboard holder 30 is connected between the rails 151.

The desk top 20 comprises a front desk top section 23, a rear upright wall 21, a rear desk top section 22 slightly downwardly sloping from the front desk top section 23 toward the rear desk top section 22, and downward side flanges 201 at two opposite lateral sides. The side flanges 201 have locating holes 202 respectively connected between the top stretchers 11 and the upright side frames 10. The bottom board 14 has downward flanges 140 at two opposite lateral sides, and locating holes 141 at the downward flanges 140 respectively connected between the bottom stretchers 13 and the upright side frames 10. A plurality of plug holes 211 are made on the Fear upright wall 21 and rear desk top section 22 of the desk top 20. A book stand 212 is fastened to the plug holes 211 for holding a number of books on the rear desk top section 22. Two parallel rods 213 are fastened to the plug holes 211 between the rear desk top section 22 and the upright rear wall 21 for holding a personal computer system on the desk top 20.

The keyboard holder 30 comprises a flat tray 31 defining a plurality of open chambers 301 for keeping stationery accessories. The flat tray 31 has two mounting grooves 311 bilaterally disposed at the bottom and respectively fastened to the rails 151 at the front side, and two locating blocks 313 bilaterally disposed at the front side. The top side of each of the locating blocks 313 slopes backwards.

Figure 4A:
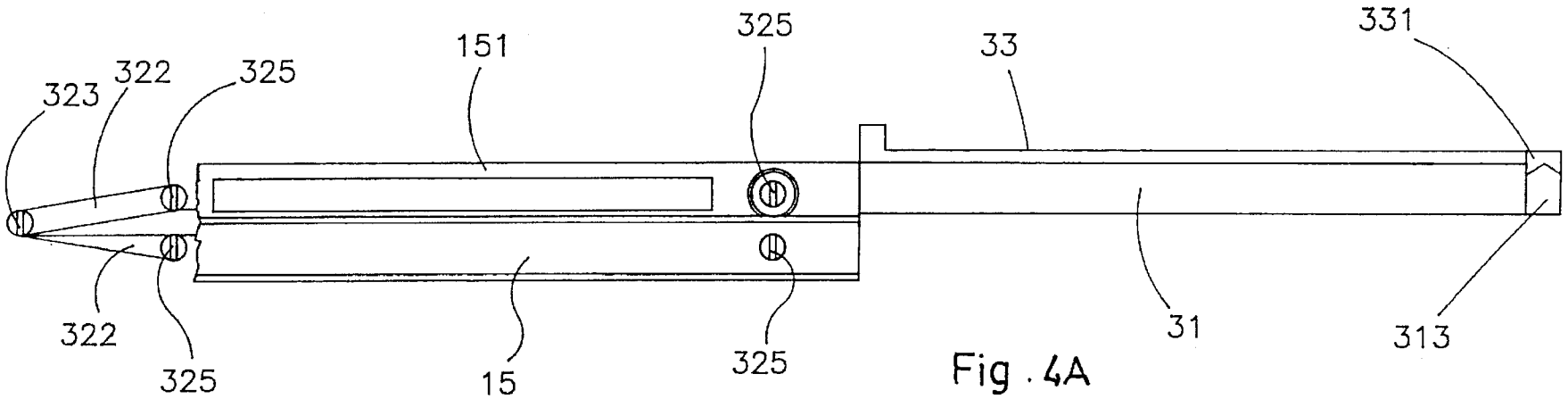
FIG. 4A is a side plain view showing elevation-adjustable connecting devices connected between the rails and the track of the upright side frames according to the present invention.
Figure 4B:
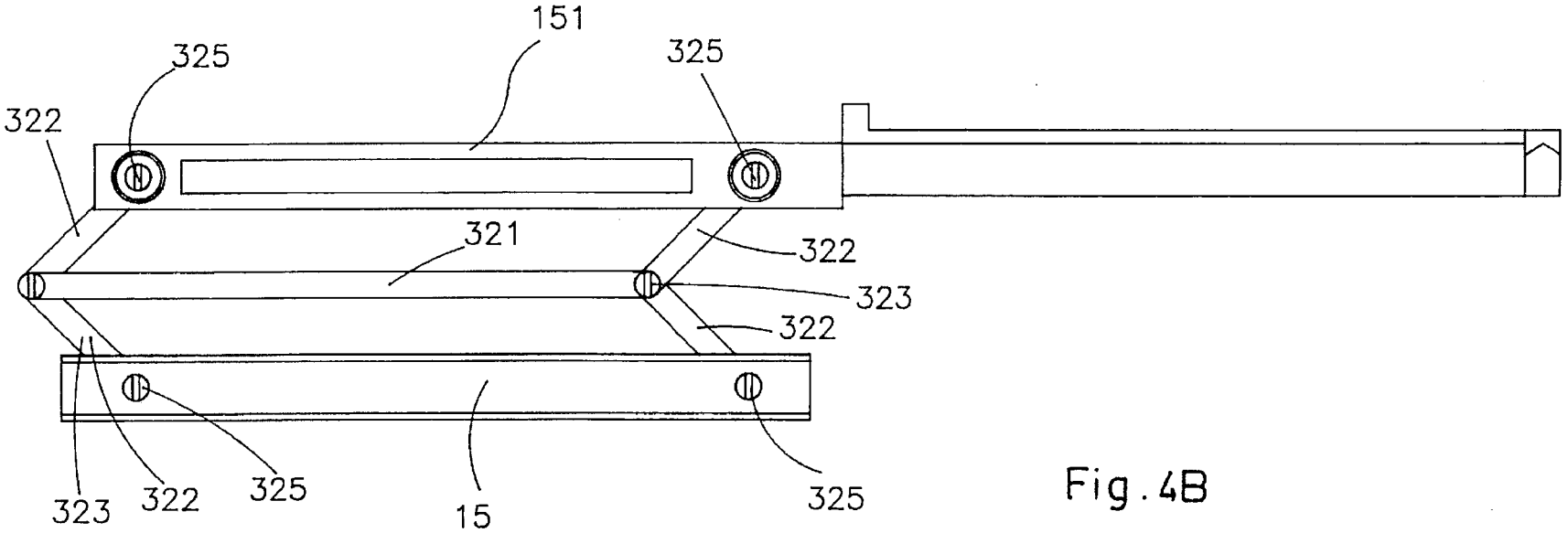
FIG. 4B is similar to FIG. 4A but shown the elevation-adjustable connecting devices adjusted.

Each of the elevation-adjustable connecting devices 32 comprises an elongated rod 321, two pairs of links 322 pivotably connected to two opposite ends of the elongated rod 321 by screws 323. The free ends 324 of the links 322 are respectively connected to the rear ends of the rails 151 and the tracks 15 by respective screws 325. The elevation of the keyboard holder 30 can be conveniently adjusted by loosening the screws 323 and then changing the contained angle between each pair of links 322 (see FIGS. 4A and 4B).

Figure 5B:
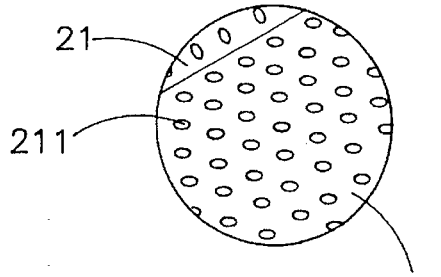
FIG. 5B is a partial view in an enlarged scale of a part of the rear desk top section of the desk top of the computer desk shown in FIG. 5A.
Figure 5A:
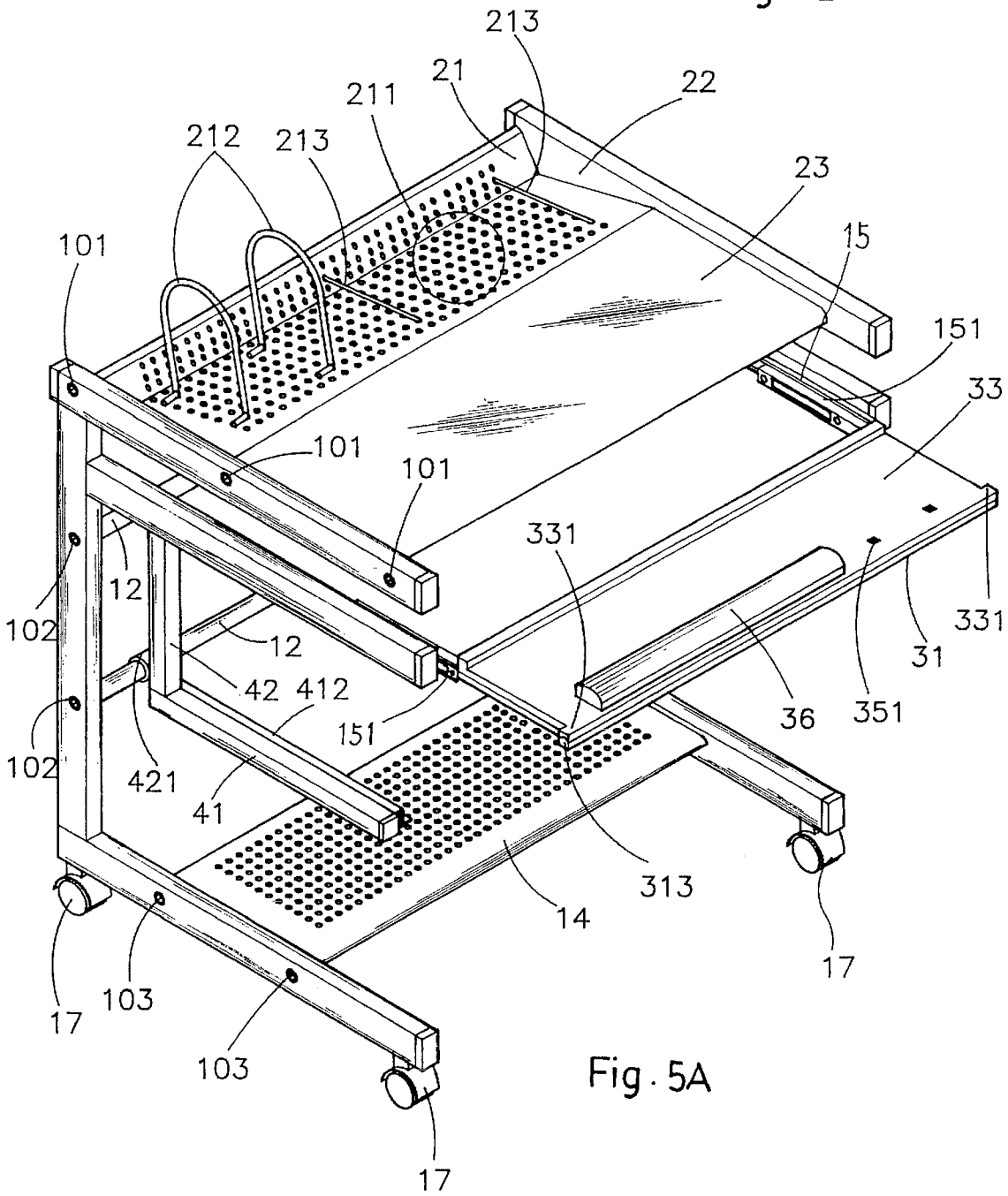
FIG. 5A is similar to FIG. 2 but showing the keyboard holder pulled out of the computer desk.
Figure 5C:
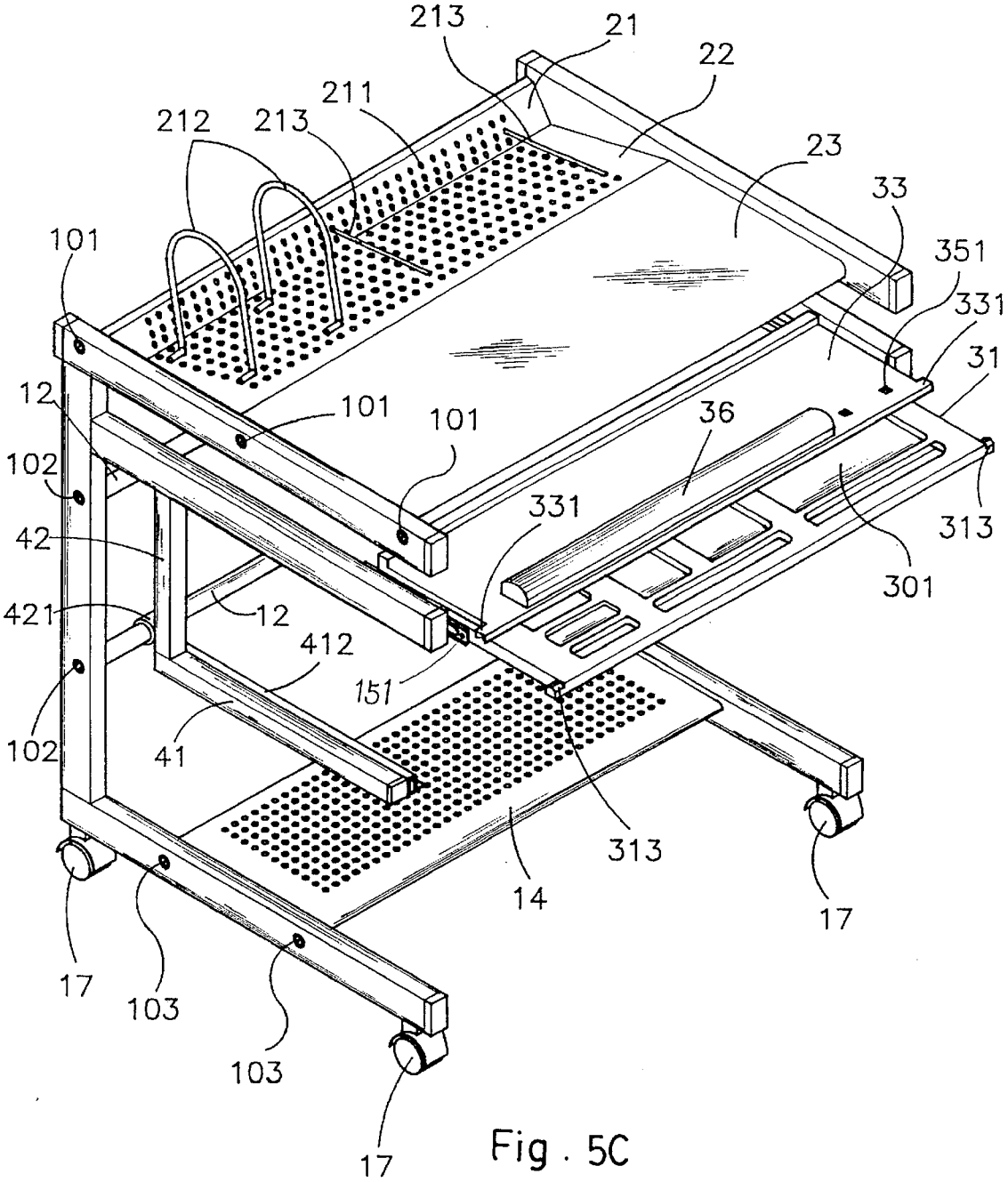
FIG. 5C similar to FIG. 5A but showing the keyboard carrier plate pushed backwards relative to the flat tray.

A keyboard carrier plate 33 is mounted on the tracks 15 above the flat tray 31, having two locating blocks 331 bilaterally disposed at the front side. The bottom side of each of the locating blocks 331 slopes backwards for engagement with the locating blocks 313 of the flat tray 31. When to pick up things from the open chambers 301 of the flat tray 31, the keyboard holder 30 is pulled out of the computer desk, and then the keyboard carrier plate 33 is pushed backwards (see FIGS. 5A, 5B, and 5C). Furthermore, a row of locating holes 351 is made on the keyboard carrier board 33 along its front side for mounting an armrest 36. The armrest 36 is an elongated cushion having downward pins 381 fitted into ! the locating holes 351.

The rack 40 comprises two vertical bars 42 and two horizontal bars 41 respectively and fixedly connected to the vertical bars 42 at the bottom at right angles. Each of the horizontal bars 41 defines a horizontal sliding track 411 at an inner side. Two angle bars 412 are respectively moved in the sliding tracks 411 of the horizontal bars 41 for carrying a computer peripheral equipment. Each of the angle bars 412 has two longitudinal slots 413 near two opposite ends., and two stop plates 414 respectively fastened to the longitudinal slots 413 by screws 415 for holding the computer peripheral equipment in place. Each of the vertical bars 42 has two barrels 421 at the back side at different elevations respectively and slidably sleeved onto the back stretchers 12.

I claim:

1. A computer desk comprising two opposite upright side flames respectively equipped with swivel wheels for moving, each of said upright side frames defining a horizontal sliding track at an inner side, a plurality of top stretchers connected between said upright side frames at a top side by screws, a desk top mounted on said top stretchers, a plurality of back stretchers connected between said upright side frames at a back side at different elevations by screws, a rack mounted on said back stretcher for holding things, a plurality of bottom stretchers connected between said upright side frames at a bottom side by screws, a bottom plate mounted on said bottom stretchers, two rails respectively connected to said horizontal sliding tracks, and a keyboard holder connected between said rails, wherein said desk top comprises a front desk top section, a rear upright wall, a rear desk top section sloping downwards from said front desk top section toward said rear upright wall, a plurality of plug holes over said rear upright wall and said rear desk top section, a book stand fastened to said plug holes for holding a number of books on said rear desk top section and two parallel rods fastened to said plug holes between said rear desk top section and said upright rear wall for holding a personal computer system on said desk top.

2. The computer desk of claim 1 wherein said keyboard holder is connected to said rails by two elevation-adjustable connecting devices, each of said elevation-adjustable connecting devices comprising an elongated rod, and two pairs of links pivotably connected to two opposite ends of said elongated rod by screws, the links of said two pairs of links having a respective free end respectively connected to said rails and the tracks of said upright side frames by respective screws.

3. The computer desk of claim 1 wherein said keyboard holder comprises a flat tray defining a plurality of open chambers for keeping stationery accessories, and a keyboard carrier plate mounted on the tracks of said upright side frames and covered over said flat tray, said flat tray having two mounting grooves bilaterally disposed at a bottom side and respectively fastened to said rails.

4. The computer desk of claim 3 wherein said keyboard carrier plate has a row of locating holes along a front side thereof, and an armrest having two downward pins fitted into said row of locating holes.

5. The computer desk of claim 3 wherein said flat tray has two;beveled locating blocks bilaterally disposed at a front side thereof; said keyboard carrier plate has two beveled locating blocks bilaterally disposed at a front side thereof and detachably forced into engagement with the beveled locating blocks of said flat tray.

6. The computer desk of claim 1 wherein said rack comprises two vertical bars, two horizontal bars respectively and fixedly connected to said vertical bars at at right angles, each of said horizontal bars defining a horizontal sliding track at an inner side, two angle bars respectively moved in the sliding tracks of said horizontal bars for carrying a computer peripheral equipment, each of said angle bars having two longitudinal slots near two opposite ends, and two stop plates respectively fastened to said longitudinal slots by screws for holding the computer peripheral equipment in place, each of said vertical bars having two barrels at different elevations respectively and slidably sleeved onto said back stretchers.

7. A computer desk comprising two opposite upright side frames respectively equipped with swivel wheels for moving, each of said upright side frames defining a horizontal sliding track at an inner side, a plurality of top stretchers connected between said upright side frames at a top side by screws, a desk top mounted on said top stretchers, a plurality of back stretchers connected between said upright side frames at a back side at different elevations by screws, a rack mounted on said back stretcher for holding things, a plurality of bottom stretchers connected between said upright side frames at a bottom side by screws, a bottom plate mounted on said bottom stretchers, two rails respectively connected to said horizontal sliding tracks, and a keyboard holder connected between said rails, wherein said keyboard holder comprises a flat tray defining a plurality of open chambers for keeping stationery accessories, and a keyboard carrier plate mounted on the tracks of said upright side frames and covered over said flat tray, said flat tray having two mounting grooves bilaterally disposed at a bottom side and respectively fastened to said rails.

8. The computer desk of claim 7 wherein said keyboard holder is connected to said rails by two elevation-adjustable connecting devices, each of said elevation-adjustable connecting devices comprising an elongated rod, and two pairs of links pivotably connected to two opposite ends of said elongated rod by screws, the links of said two pairs of links having a respective free end respectively connected to said rails and the tracks of said upright side frames by respective screws.

9. The computer desk of claim 7, wherein said keyboard carrier plate has a row of locating holes along a front side thereof, and an armrest having two downward pins fitted into said row of locating holes.

10. The computer desk of claim 7, wherein said flat tray has two beveled locating blocks bilaterally disposed at a front side thereof; said keyboard carrier plate has two beveled locating blocks bilaterally disposed at a from side thereof and detachably forced into engagement with the beveled locating blocks of said flat tray.

11. The computer desk of claim 7, wherein said rack comprises two vertical bars, two horizontal bars respectively and fixedly connected to said vertical bars at right angles, each of said horizontal bars defining a horizontal sliding track at an inner side, two angle bars respectively moved in the sliding tracks of said horizontal bars for carrying a computer peripheral equipment, each of said angle bars having two longitudinal slots near two opposite ends, and two stop plates respectively fastened to said longitudinal slots by screws for holding the computer peripheral equipment in place, each of said vertical bars having two barrels at different elevations respectively and slidably sleeved onto said back stretchers.

12. A computer desk comprising two opposite upright side frames respectively equipped with swivel wheels for moving, each of said upright side frames defining a horizontal sliding track at an inner side, a plurality of top stretchers connected between said upright side frames at a top side by screws, a desk top mounted on said top stretchers, a plurality of back stretchers connected between said upright side frames at a back side at different elevations by screws, a rack mounted on said back stretcher for holding things, a plurality of bottom stretchers connected between said upright side frames at a bottom side by screws, a bottom plate mounted on said bottom stretchers, two rails respectively connected to said horizontal sliding tracks, and a keyboard holder connected between said rails, wherein said rack comprises two vertical bars, two horizontal bars respectively and fixedly connected to said vertical bars at right angles, each of said horizontal bars defining a horizontal sliding track at an inner side, two angle bars respectively moved in the sliding tracks of said horizontal bars for carrying a computer peripheral equipment, each of said angle bars having two longitudinal slots near two opposite ends, and two stop plates respectively fastened to said longitudinal slots by screws for holding the computer peripheral equipment in place, each of said vertical bars having two barrels at different elevations respectively and slidably sleeved onto said back stretchers.

13. The computer desk of claim 12, wherein said keyboard holder is connected to said rails by two elevation-adjustable connecting devices, each of said elevation-adjustable connecting devices comprising an elongated rod, and two pairs of links pivotably connected to two opposite ends of said elongated rod by screws, the links of said two pairs of links having a respective free end respectively connected to said rails and the tracks of said upright side frames by respective screws.

14. The computer desk of claim 11, wherein said keyboard carrier plate has a row of locating holes along a front side thereof, and an armrest having two downward pins fitted into said row of locating holes.

15. The computer desk of claim 11, wherein said flat tray has two beveled locating blocks bilaterally disposed at a front side thereof; said keyboard carrier plate has two beveled locating blocks bilaterally disposed at a front side thereof and detachably forced into engagement with the beveled locating blocks of said flat tray.

* * * * *